US009995489B2

(12) United States Patent
Amlin

(10) Patent No.: US 9,995,489 B2
(45) Date of Patent: Jun. 12, 2018

(54) PELLET STOVE

(71) Applicant: William K. Amlin, Creswell, OR (US)

(72) Inventor: William K. Amlin, Creswell, OR (US)

( * ) Notice: Subject to any disclaimer, the term of this patent is extended or adjusted under 35 U.S.C. 154(b) by 346 days.

(21) Appl. No.: 14/756,577

(22) Filed: Sep. 17, 2015

(65) Prior Publication Data

US 2017/0082292 A1 Mar. 23, 2017

(51) Int. Cl.

| | |
|---|---|
| ***F24B 13/00*** | (2006.01) |
| ***F24B 13/02*** | (2006.01) |
| ***F24B 13/04*** | (2006.01) |
| ***F23L 11/02*** | (2006.01) |
| ***F23B 10/02*** | (2011.01) |
| ***F23B 50/12*** | (2006.01) |
| ***F23B 80/04*** | (2006.01) |
| ***F24B 1/02*** | (2006.01) |

(52) U.S. Cl.

CPC ..... *F24B 13/02* (2013.01); *F23B 10/02* (2013.01); *F23B 50/12* (2013.01); *F23B 80/04* (2013.01); *F23L 11/02* (2013.01); *F24B 1/024* (2013.01); *F24B 1/026* (2013.01); *F24B 13/008* (2013.01); *F24B 13/04* (2013.01)

(58) Field of Classification Search

CPC ..... F23B 50/00; F23B 10/00

USPC ..... 126/61, 58, 112, 73, 68; 110/110 R

See application file for complete search history.

(56) References Cited

U.S. PATENT DOCUMENTS

| | | | | |
|---|---|---|---|---|
| 2,157,195 | A * | 5/1939 | Weeks | F23B 50/04 110/293 |
| 4,226,195 | A * | 10/1980 | Lindroos | F24H 1/26 110/188 |
| 4,320,738 | A * | 3/1982 | Johnson | F24B 5/021 126/69 |
| 5,893,358 | A * | 4/1999 | Whitfield | F23B 1/38 110/110 |
| 7,861,707 | B2 | 1/2011 | Wisener | |
| 2007/0186920 | A1 * | 8/2007 | Wisener | F23B 1/38 126/77 |
| 2008/0066731 | A1 * | 3/2008 | Johnson | F23B 50/12 126/73 |

* cited by examiner

*Primary Examiner* — Avinash Savani
(74) *Attorney, Agent, or Firm* — Robert E. Howard

(57) ABSTRACT

A pellet stove having a combustion assembly housing. Located within the housing in a vertical array are a primary combustion chamber, a secondary combustion chamber located below the primary combustion chamber, and an ash receptacle located below the secondary combustion chamber. The primary combustion chamber communicates with the secondary combustion chamber, and the secondary combustion chamber communicates with the ash receptacle. A pellet feed housing is located above the primary combustion chamber and has a feed plate configured to feed pellets directly into the primary combustion chamber along an inclined path. Air intake ducts communicate ambient air with the interior of the housing. The primary combustion chamber communicates with a combustion gas conduit that conducts combustion gases along an upwardly extending tortuous path to an exhaust stack to provide heating. A pivotal, latchable door is attached to the front of the combustion assembly housing.

15 Claims, 7 Drawing Sheets

PELLET STOVE

BACKGROUND OF THE INVENTION

The present invention relates to an improved pellet stove, and, in particular, to an improved gravity fuel delivery system for a pellet stove.

Prior to the advent of centralized heating by use of hydrocarbon fuels, most residential structures were heated by fireplaces or stoves using wood or coal as fuel. Even today many rural homes continue to be primarily or secondarily heated by such heat sources. However, such heat sources are infamous air polluters, especially in the amount of particulate matter emitted into the atmosphere. During adverse weather conditions, such as periods of stagnant air, many jurisdictions ban the use of such heat sources for so long as such conditions continue to exist.

Relatively recently pellet stoves have been introduced that lower obnoxious emissions. Many models utilize electric motor driven fans or blowers to direct air into the stove's combustion chamber and to drive an auger to deliver pellets to the combustion chamber. Such stoves that are dependent upon electricity are not useful during power outages or in locations where there is no power.

Pellet stoves have been developed which use gravity feed to deliver pellets from a hopper to the combustion chamber, and use the natural draft generated by heated air flowing from the combustion chamber to the outlet of the venting system to obviate the need for electricity to operate fans and feed augers. However, many of these stoves do not efficiently combust the pellet fuel which results in particulate emissions which exceed EPA and/or state emission standards. Many such pellet stoves suffer from "burn-back" problems in which pellets in the feed delivery system and/or pellet supply hopper are ignited.

SUMMARY OF THE INVENTION

The pellet stove of the present invention has a combustion assembly housing having an air intake end and a combustion gas exhaust gas end. Located within the housing in a vertical array are an upper primary combustion chamber, a secondary combustion chamber located beneath the primary combustion chamber, and an ash receptacle located beneath the secondary combustion chamber.

The primary combustion chamber vertically communicates with the secondary combustion chamber, and the secondary combustion chamber vertically communicates with the ash receptacle so that incompletely burned pellets from the primary combustion chamber can fall into the secondary combustion chamber, and ash from the secondary combustion chamber can fall into the ash receptacle.

A pellet feeder feeds pellets into the primary combustion chamber along an inclined path formed by a removable pellet feed plate. A pellet supply hopper and pellet transfer tube supplies pellets to the pellet feeder by gravity.

The combustion assembly housing has a door located at the air intake end to provide access to the interior of the housing. When closed, air intake ducts in the door communicate the exterior of the housing with the interior thereof.

A combustion gas conduit communicates the combustion gases from the primary combustion chamber with an exhaust stack configured along an upwardly extending tortuous path.

In operation, pellet fuel is placed into the pellet supply hopper and the pellets are caused to descend by gravity through the pellet transfer tube into the pellet feeder. Inside the pellet feeder the pellets descend down the pellet feed plate along an inclined path and into the primary combustion chamber.

Upon commencement of use, the user opens the door of the combustion assembly housing, ignites the pellets located in the pellet receptacle located within the primary combustion chamber by any suitable ignition source such as a gas torch, and closes and latches the door.

Once the pellets in the pellet receptacle of the primary combustion chamber are ignited and burning, combustion gases that are created pass upwardly through the combustion gas conduit from an entry end located adjacent the exit end of the primary combustion chamber to an exit end communicating with an exhaust stack along an upwardly extending tortuous path. The combustion gas heats the combustion gas conduit which heats the surrounding environment. The gases remaining at the exit end of the combustion gas conduit are exhausted through an exhaust stack to the exterior of the structure being heated. This movement of heated gases through the combustion gas conduit draws ambient air into and through the secondary combustion chamber via the air intake ducts passing through the door of the combustion assembly housing, and ultimately into and through the primary combustion chamber.

As pellets in the primary combustion chamber are substantially burned, their residue falls by gravity onto the grates of the secondary combustion chamber located vertically below, where burning is completed.

The ash formed in secondary combustion chamber then falls by gravity into the ash receptacle located vertically below the secondary combustion chamber.

Combustion can be controlled by adjusting a draft control mechanism located in the combustion gas conduit.

DESCRIPTION OF PREFERRED EMBODIMENTS

Figure 1:
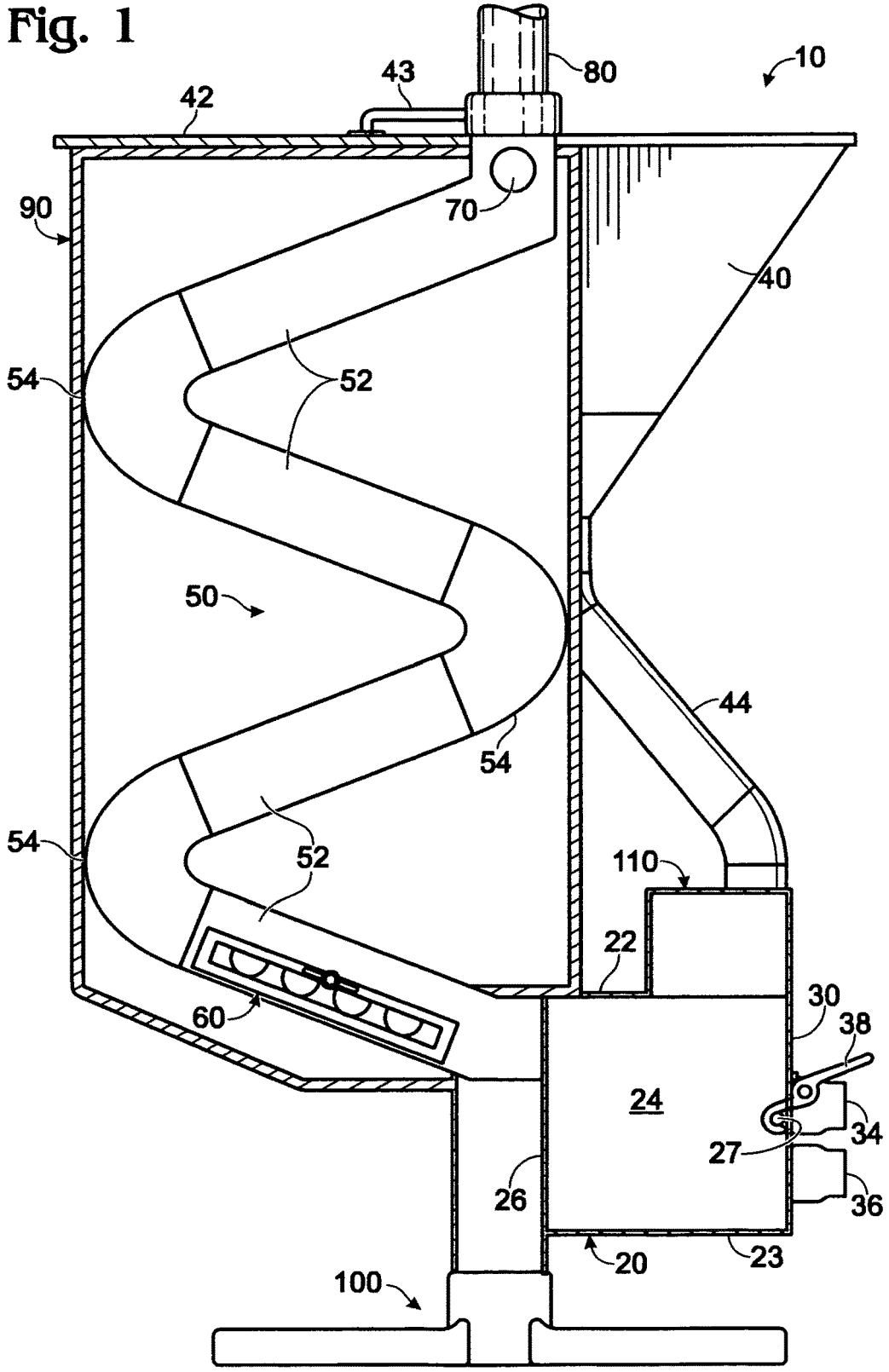
FIG. 1 is a front elevation view of the improved pellet stove of the present invention.
Figure 2:
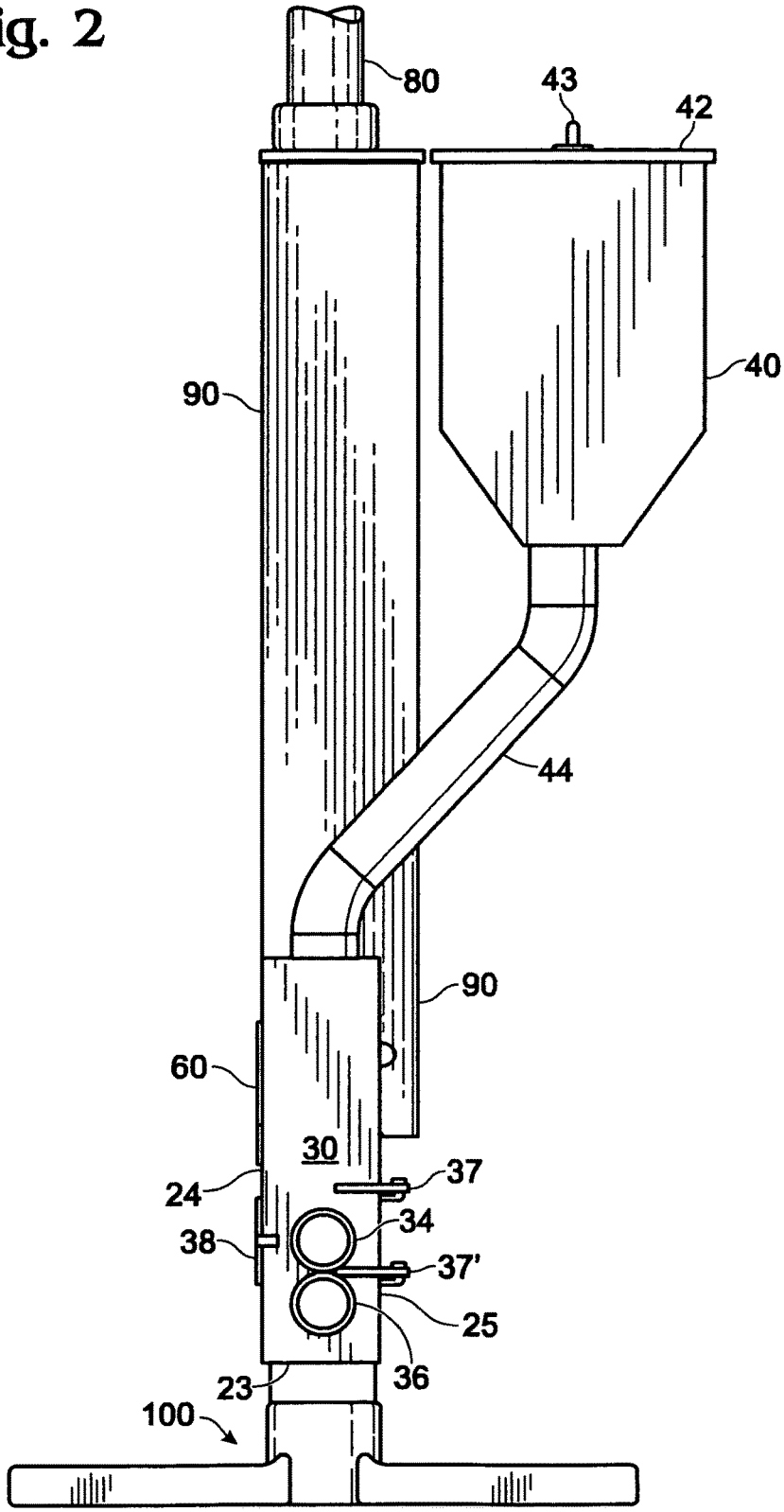
FIG. 2 is a side elevation view of the pellet stove.
Figure 3:
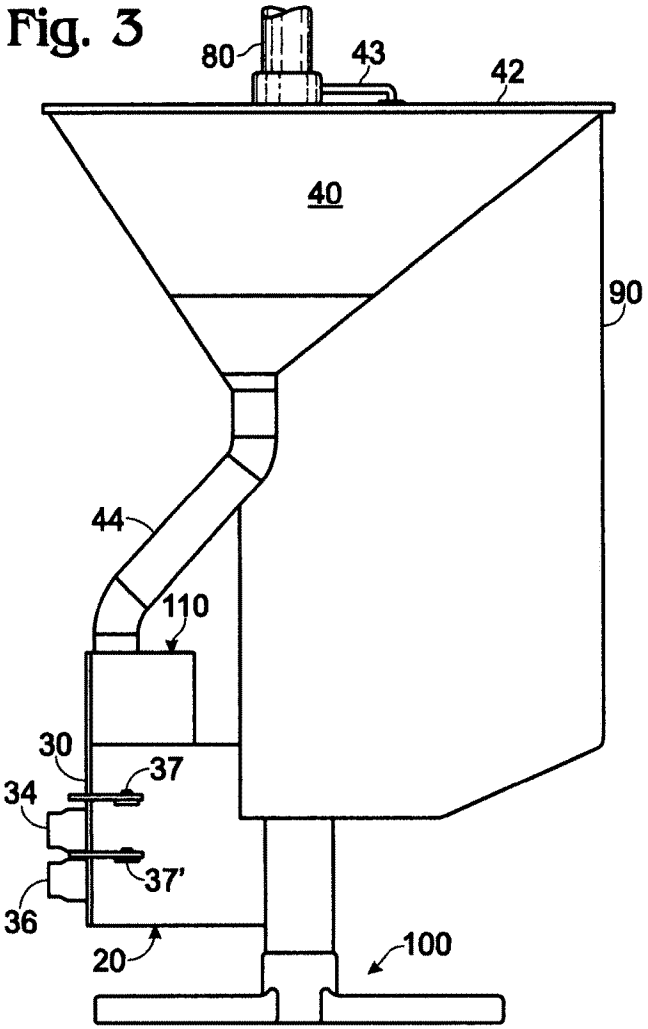
FIG. 3 is a rear elevation view of the pellet stove.
Figure 6:
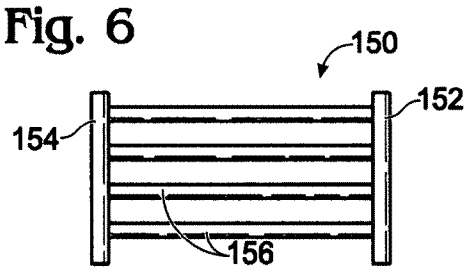
FIG. 6 is a top view of the primary ignition receptacle of the grate insert subassembly of the primary chamber combustion assembly of the pellet stove.
Figure 7:
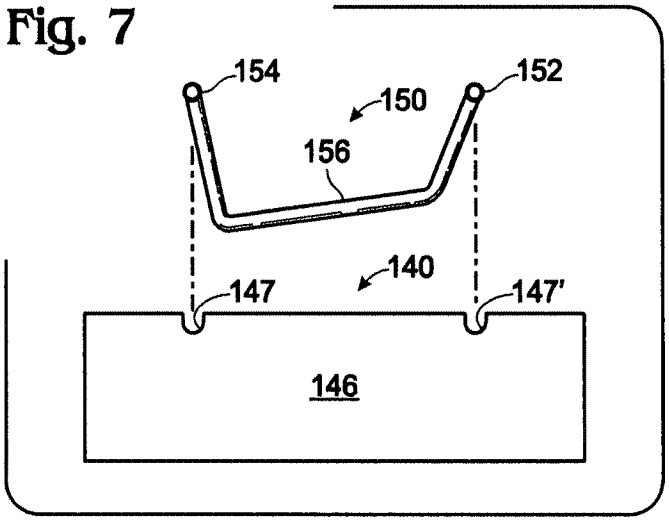
FIG. 7 is an exploded view of the primary ignition receptacle and grate insert subassembly of the primary combustion assembly of the pellet stove.

Briefly, the pellet stove 10 of the present invention includes a combustion assembly housing 20, a pellet supply hopper 40 having a lid 42 and lid handle 43, a pellet transfer tube 44, a pellet feed housing 110, a combustion gas conduit 50 having a draft control mechanism 60 located therein, a thermometer 70, an exhaust stack 80, a vertical support cabinet 90 open in the front and closed in the rear, and a support stand 100. All parts are preferably formed of steel and/or aluminum.

Combustion assembly housing 20 has a ceiling 22, a floor 23, front and rear side walls 24 and 25, respectively, and a rear wall 26. Rear wall 26 has an upper opening (not shown) therein for receiving the lower, entry end of combustion gas conduit 50.

The rear wall 26 end of combustion assembly housing 20 will sometimes be referred to as the "exhaust" end.

Pivotally attached to the front of combustion assembly housing 20 by upper and lower hinges 37, 37' is a door 30. Door 30 is formed of steel or aluminum, and preferably has high temperature insulation material (not shown) attached to the inner side thereof. Passing through door 30 are upper and lower ambient air intake ducts 34 and 36, respectively. Door 30 can be kept closed during use of the stove by latch means 38 attached to a mating latch member 27 located on combustion assembly housing 20. A handle (not shown) can be used to open and close door 30.

The end of combustion assembly housing 20 containing door 30 and air intake ducts 34 and 36 will sometimes be referred to as the "intake" end.

Figure 12:
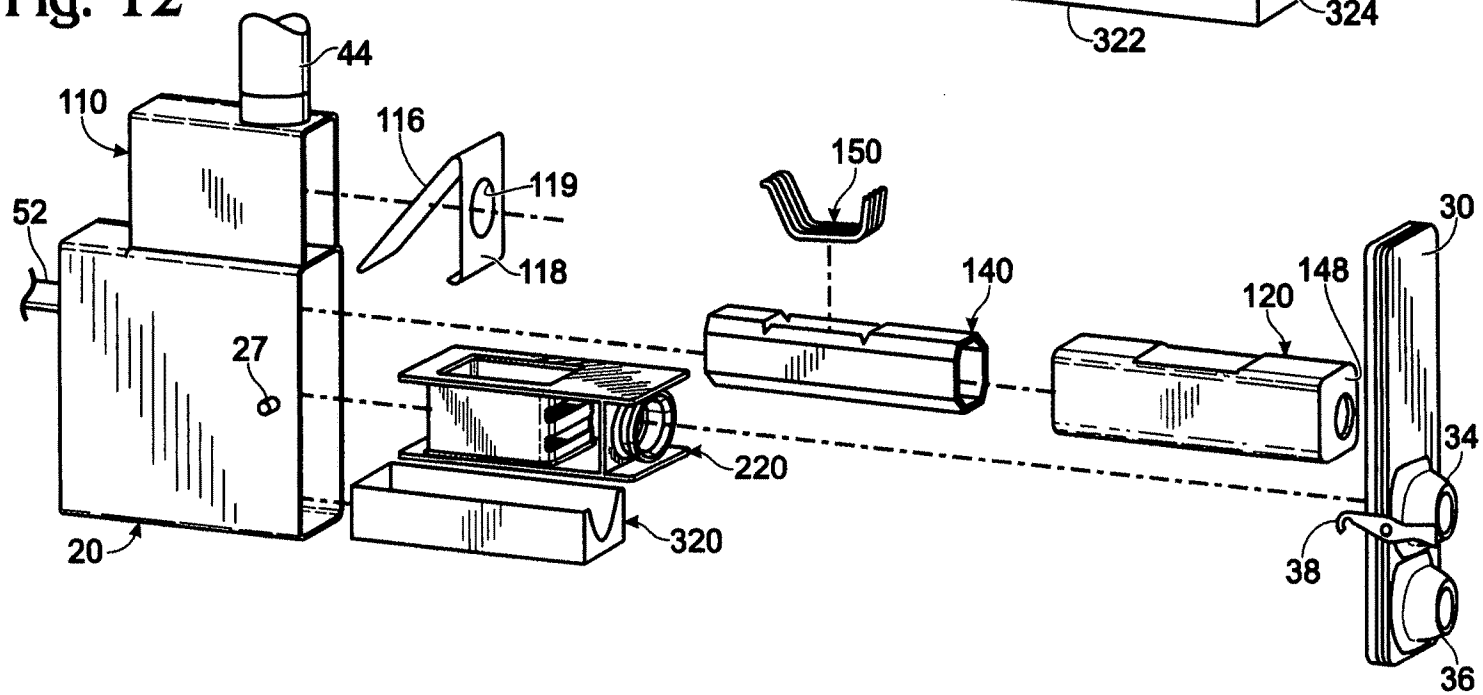
FIG. 12 is an exploded view of the combustion assembly housing and pellet feed housing showing their internal subassemblies.
Figure 11:
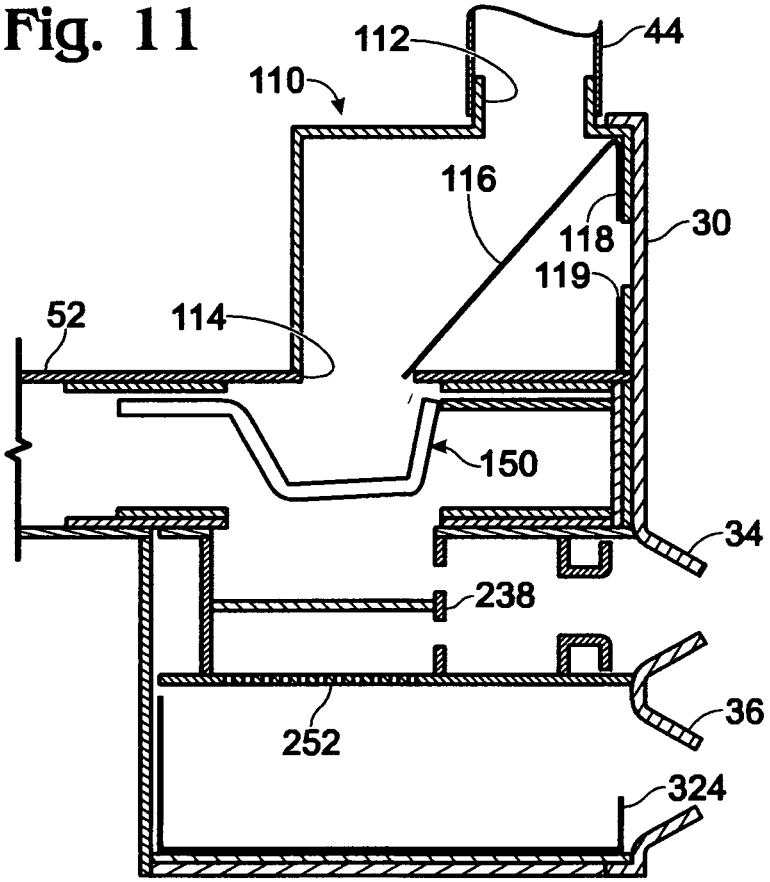
FIG. 11 is a sectional view through the center of the combustion housing and pellet feed housing.

Located within combustion assembly housing 20, in a removable vertical array, are a primary burn chamber assembly 120, a secondary burn chamber assembly 220, and an ash receptacle 320, as best seen in FIGS. 11 and 12.

Primary burn chamber assembly 120 is located above secondary burn chamber assembly 220, and secondary burn chamber assembly 220 is located above ash receptacle assembly 320. Each of assemblies 120, 220, and 320 extend substantially from the front end to the rear end of combustion assembly housing 20 and extend substantially between side walls 24 and 25. Assemblies 120, 220, and 320, in total, extend substantially from the floor 23 to the ceiling 22 of combustion assembly housing 20. Assemblies 120, 220, and 320 can be removably stacked on top of one another, or have edges that fit into slots formed in the side walls 24, 25 of combustion assembly housing 20, or be removably positioned within housing 20 by any other suitable means.

As best seen in FIGS. 4A-E, 5A-C, 6 and 7, primary burn chamber assembly 120 is preferably formed of a rectangular-shaped hollow tubular metal sleeve 130 and a rectangular-shaped tubular grate insert 140 which is adapted to be fully and removably inserted into sleeve 130

Figure 4A:
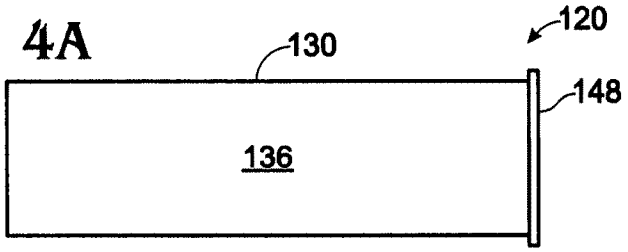
FIG. 4A is a side view of the primary combustion chamber assembly of the pellet stove.
Figure 4B:
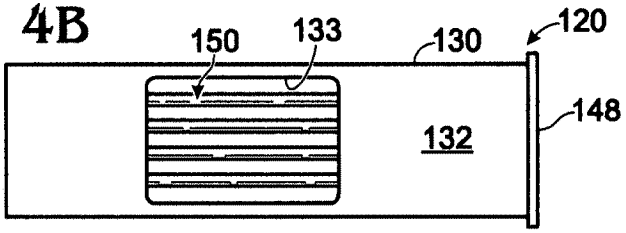
FIG. 4B is a top view of the primary combustion chamber assembly of the pellet stove.
Figure 4C:
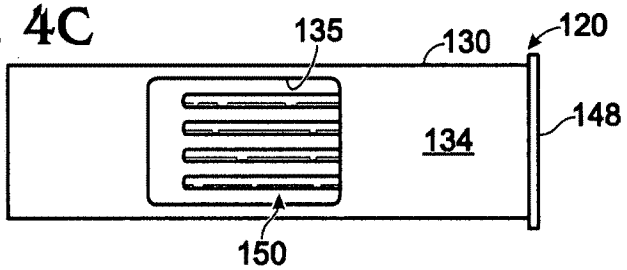
FIG. 4C is a bottom view of the primary chamber combustion assembly of the pellet stove.
Figure 4E:
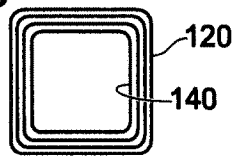
FIG. 4E is a rear view of the primary chamber combustion assembly of the pellet stove.
Figure 4D:
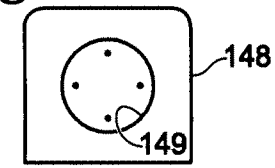
FIG. 4D is a front view of the primary chamber combustion assembly of the pellet stove.
Figure 5A:
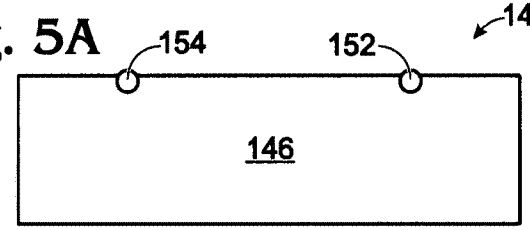
FIG. 5A is a side view of the grate insert subassembly of the primary chamber combustion assembly of the pellet stove.
Figure 5B:
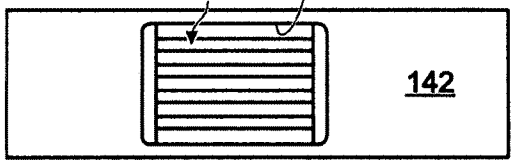
FIG. 5B is a top view of the grate insert subassembly of the primary chamber combustion assembly of the pellet stove.
Figure 5C:
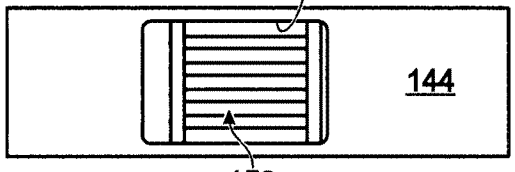
FIG. 5C is a bottom view of the grate insert subassembly of the primary chamber combustion assembly of the pellet stove.

Sleeve 130 has a top wall 132, bottom wall 134, and opposing side walls 136 and 136'. Top wall 132 has an upper opening 133 therein and bottom wall 134 has a lower opening 135 therein. Openings 133 and 135 are substantially in alignment with each other. As seen in FIG. 4D, sleeve 130 has a plate 148 attached to its front end, such as by welding. Plate 148 has an opening 149 located substantially in its center to aid in manual removal of primary burn chamber assembly 120 from housing 20, but forms no part of the air circulation path. As seen in FIG. 4E, sleeve 130 is open at its rear end.

Grate insert 140 has a top wall 142, a bottom wall 144, and side walls 146 and 146'. Top wall 142 has an upper grate receiving opening 143 therein which is in substantial alignment with opening 135 in the bottom wall 134 of sleeve 130. Bottom wall 144 has a lower grate discharge opening 145 therein which is in substantial alignment with upper grate receiving opening 143 in the top wall 142. Grate insert 140 is open at both its front (outer) and rear (inner) ends. The rear end of insert 140 is open and communicates with the open entry end of combustion gas conduit 50.

A primary ignition receptacle or basket 150 (FIGS. 6 and 7) is configured to be removably received within opening 143 of grate insert subassembly 140. Primary ignition receptacle 150 includes an outer cross-member 152, an inner cross-member 154, and a plurality of substantially parallel, generally U-shaped members 156 extending between cross-members 152 and 154, sloping downwardly there between. Primary ignition receptacle 150 is inserted into opening 143 with the outer extensions of cross-members 152, 154 being supported by grooves 147, 147' located in both of the side walls 146 of insert 140.

Figure 8:
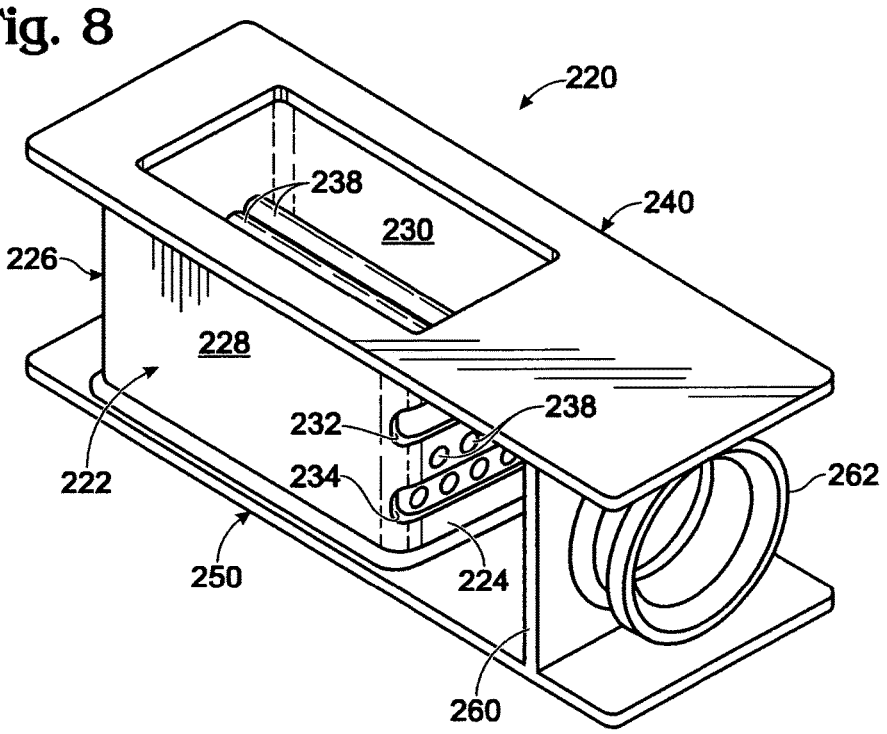
FIG. 8 is a view of the secondary combustion chamber of the pellet stove.
Figure 9:
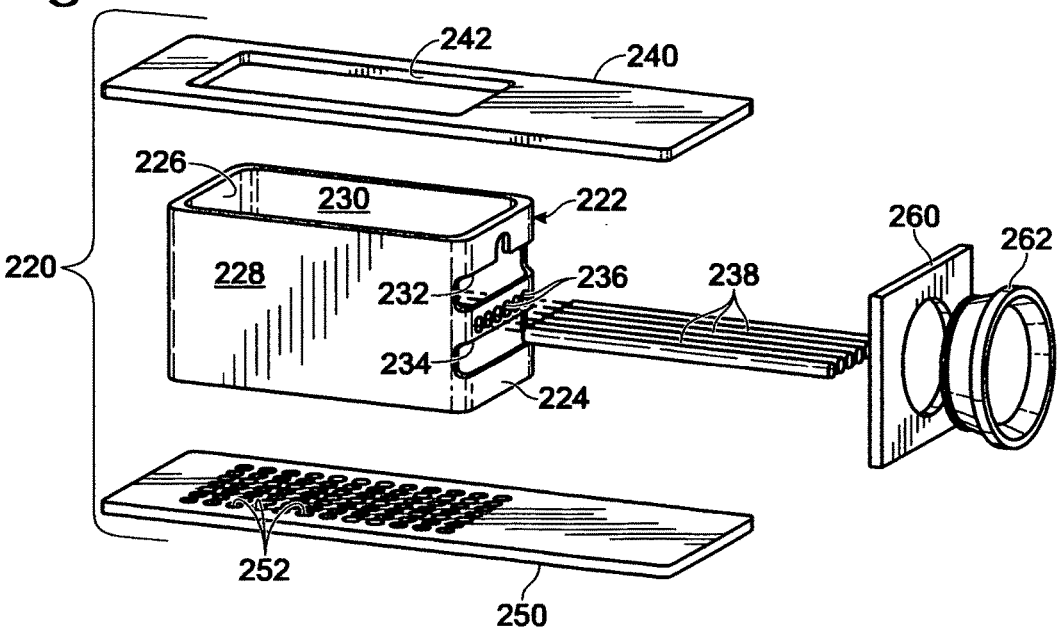
FIG. 9 is an exploded view of the secondary combustion chamber of the pellet stove.

Secondary burn chamber assembly 220 is shown in FIGS. 8 and 9. Secondary burn chamber assembly 220 includes a secondary burn chamber 222 enclosed by a front wall 224, rear wall 226, and side walls 228 and 230. The open space encompassed by front wall 224, rear wall 226, and side walls 228 and 230 is substantially the same size as the open space encompassing primary ignition receptacle 150 of primary burn chamber assembly 120 and is located in a position so that when secondary burn chamber assembly 220 and primary burn chamber assembly 120 are fully positioned within combustion assembly housing 20 the primary ignition receptacle 150 of primary burn chamber assembly 120 and secondary burn chamber 222 are substantially in alignment.

Front wall 224 of secondary burn chamber assembly 220 has an upper substantially rectangular air intake opening 232 extending there across, and a lower substantially rectangular air intake opening 234 extending there across. A plurality of circular openings 236 (FIG. 9) extend across a mid-portion of front wall 224 and are configured to receive a plurality of cylindrical grate members 238 there through. Grate members 238 extend across secondary burn chamber 222 in a substantially parallel configuration, and are received into circular openings (not shown) in rear wall 226. Grate members 238 can be held in place such as by welding. Grate members 238 are positioned substantially mid-way between upper and lower air intake openings 232 and 234.

A rectangular top plate 240 is adhered to the upper surface of secondary burn chamber 222 such as by welding. Top plate 240 has an opening 242 therein which is substantially the same size as the open space of secondary burn chamber 222 and is in alignment therewith.

A rectangular bottom plate 250 is adhered to the bottom surface of secondary burn chamber 222 such as by welding. Bottom plate 250 has a plurality of openings 252 therein, preferably circular in shape, that are located in the area below the secondary burn chamber 222, and are of a size and number to allow ash formed in the secondary burn chamber 222 to pass there through.

Rectangular top plate 240 and rectangular bottom plate 250 have substantially the same size, and have a length and width that are substantially the same as that of the interior of combustion assembly housing 20.

Located towards the forward ends of top plate 240 and bottom plate 250 is a vertical air horn support plate 260, which is welded thereto. Support plate 260 has an air horn receptacle 262 located in its mid-portion. Air horn receptacle 262 is located and configured to removably mate with that inner portion of upper air intake duct 34 located within combustion assembly housing 20 when door 30 is closed.

Figure 10:
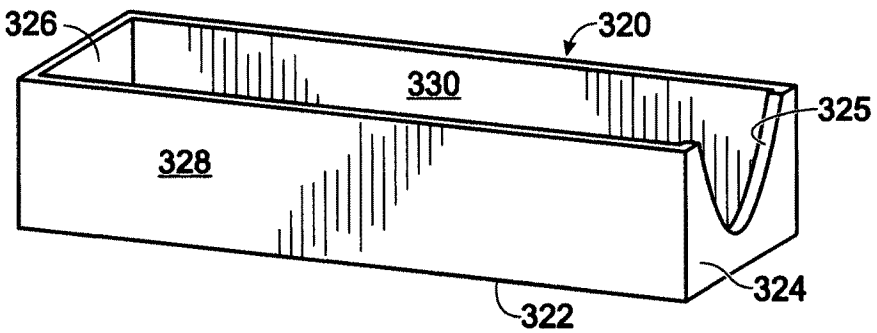
FIG. 10 is a view of the ash receiving receptacle of the pellet stove.

Ash receptacle 320 is shown in FIG. 10. Ash receptacle 320 is enclosed by a front wall 324, rear wall 326, and side walls 328 and 330. Front wall 324 has a substantially U-shaped opening 325 located therein that functions as an air intake opening that communicates with lower air intake duct 36 in door 30 of housing 20. U-shaped opening 325 also allows for easy manual removal of ash receptacle 320 from housing 20 for ash removal. The length and width of ash receptacle 320 is substantially the same as that of the interior of housing 20.

A pellet feed housing 110 is attached to the top of combustion assembly housing 20. Pellet feed housing 110 has an entry opening 112 in the top thereof that is attached to pellet transfer tube 44, and an exit opening 114 in the bottom thereof that communicates with primary ignition receptacle 150 of primary burn chamber assembly 140 through an opening in the top of combustion assembly housing 20. Entry opening 112 is located forward of exit opening 114. A removable pellet feed plate 116 slopes downwardly and rearwardly from entry opening 112 to exit opening 114, as best seen in FIG. 11. Pellet feed plate 116 is supported by a substantially vertical leg member 118. Leg member 118 has an opening 119 therein to facilitate removal of pellet feed plate 116 from pellet feed housing 110 for maintenance. The front end of pellet feed housing 110 has an open configuration but is sealed shut by the upper portion of door 30 of combustion assembly housing 20 during operation, as can best be seen in FIG. 12. It has been found that such a configuration, which feeds the pellets on an incline into the primary combustion chamber instead of employing a vertical drop, prevents burn-back problems encountered by other pellet stoves.

Combustion gas conduit 50 forms a zig-zag tortuous path to maximize heating area exposure in the smallest space. Combustion gas conduit 50 is preferably formed of straight sections 52 of tubular metal conduit, preferably generally square or rectangular in cross-section, and preferably joined together with elbow members 54 where a direction change occurs.

In operation, pellet fuel is placed into hopper 40, and a valve (not shown), such as a slide valve, opened to allow the pellets to descend by gravity through transfer tube 44 into pellet feed housing 110 through entry opening 112. The pellets then slide down sloped feed plate 116 and into primary ignition receptacle 150 of primary combustion chamber 120 through exit opening 114. The amount of pellets entering primary ignition receptacle 150 of combustion chamber 120 is inherently self limiting.

The user opens door 30, ignites the pellets in primary ignition receptacle 150 by any suitable ignition source typically used in igniting pellets in a pellet stove, such as a gas torch, and closes and latches door 30.

Once the pellets in the primary combustion chamber 120 are ignited and burning, combustion gases pass from primary ignition receptacle 150 into and through combustion gas conduit 50. The hot combustion gases flowing through combustion gas conduit 50 travel along a tortuous path. Ultimately the combustion gases are exhausted through exhaust stack 80. This movement of combustion gases through combustion gas conduit 50 creates a venturi effect which draws ambient air into combustion assembly housing 20 via air intake ducts 34 and 36. Air entering through air intake duct 36 passes through ash receptacle 320. Air entering through air intake duct 34 passes through secondary burn chamber 222. Both streams of air ultimately pass through primary ignition receptacle 150 to provide oxygen to support combustion in both the primary and secondary burn chambers 120 and 220.

As pellets in the primary combustion chamber 120 are substantially burned, their residue falls through grates 156 of primary ignition receptacle 150 onto the grates 238 of secondary combustion chamber 220 where burning is substantially completed.

The ash formed in secondary combustion chamber 220 then falls through grates 238 into ash receptacle 320.

Combustion can be controlled by adjusting draft control 60. Draft control 60 is of the type conventionally used in stoves, and includes a plurality of spaced apart holes in a lower portion of combustion gas conduit 50, a sliding bar that has a plurality of holes or slots that can be moved into or out of register with the holes in the combustion gas conduit 50, either wholly or partially to control the amount of ambient air entering combustion gas conduit 50, and a handle for moving the bar.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A pellet stove comprising:

a combustion assembly housing having a top, bottom, front, rear wall, and opposing side walls;

a primary combustion chamber assembly located within said housing, said primary combustion chamber assembly including a tubular sleeve and a tubular grate insert configured to be removably inserted into said tubular sleeve, tubular sleeve having a top wall, a bottom wall, and opposing side walls, said tubular sleeve having a rear end that is open and a front end that has an opening configured to receive a pellet ignition source, said top wall having an upper opening therein and said bottom wall having a lower opening therein, said upper and lower openings being in substantial vertical alignment;

a secondary combustion chamber assembly located within said housing below said primary combustion chamber assembly;

an ash receptacle located within said housing below said secondary combustion chamber assembly;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path;

first and second air intake ducts communicating the exterior of said housing with the interior of said combustion assembly housing; and combustion gas conduit means communicating with said primary combustion chamber assembly and configured to transmit combustion gases produced within said combustion assembly housing along a tortuous path to thereby heat the environment located in heating proximity to said pellet stove.

2. The pellet stove of claim 1 wherein said first air intake duct communicates the exterior of said housing with said secondary combustion chamber assembly through the front of said housing.

3. The pellet stove of claim 1 wherein said second air intake duct communicates the exterior of said housing with said ash receptacle through the front of said housing.

4. The pellet stove of claim 1 wherein said tubular grate insert has a top wall, a bottom wall, and opposing side walls, said grate insert being open at its front and rear ends, said top wall having an upper grate receiving opening therein and said bottom wall having a lower grate discharge opening therein, said upper grate receiving opening and said lower grate discharge opening being in substantial vertical alignment with each other and with said upper and lower openings of said tubular sleeve, and a primary ignition receptacle located within the space between said upper and lower grate receiving openings.

5. A pellet stove comprising:

a combustion assembly housing having a top, bottom, front, rear wall, and opposing side walls;

a primary combustion chamber assembly located within said housing;

a secondary combustion chamber assembly located within said housing below said primary combustion chamber assembly, said secondary burn chamber assembly includes a secondary burn chamber having a front wall, rear wall, side walls, a top plate extending over the upper surface of said secondary burn chamber, a bottom plate extending under the bottom surface of said secondary burn chamber, said top plate having an upper opening substantially in alignment with said grate discharge opening in said bottom wall of said grate insert of said primary burn chamber assembly, said bottom plate having a plurality of ash discharge openings therein in the area beneath said secondary burn chamber, a grate extending across a mid-portion of said secondary burn chamber, said front wall of said secondary burn chamber having at least one air intake opening therein communicating with said first air intake duct;

an ash receptacle located within said housing below said secondary combustion chamber assembly;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path;

first and second air intake ducts communicating the exterior of said housing with the interior of said combustion assembly housing; and combustion gas conduit means communicating with said primary combustion chamber assembly and configured to transmit combustion gases produced within said combustion assembly housing along a tortuous path to thereby heat the environment located in heating proximity to said pellet stove.

6. The pellet stove of claim 5 wherein said grate is comprised of a plurality of grate members spaced apart a distance adapted to receive and hold partially burned pellets dropping down from said primary burn chamber assembly.

7. The pellet stove of claim 6 wherein a first air intake opening is located in said front wall above said grate members and a second air intake opening is located in said on wall below said grate members.

8. The pellet stove of claim 5 wherein said ash discharge openings are circular in shape and are of a size and number that allows ash formed in said secondary burn chamber to pass there through and drop into said ash receptacle.

9. The pellet stove of claim 5 wherein said top and bottom plates extend forwardly of said secondary burn chamber and have an air horn located there between configured to mate with the inner portion of said first air intake duct.

10. A pellet stove comprising:

a combustion assembly housing having a top, bottom, front, rear wall, and opposing side walls;

a primary combustion chamber assembly located within said housing;

a secondary combustion chamber assembly located within said housing below said primary combustion chamber assembly;

an ash receptacle located within said housing below said secondary combustion chamber assembly, said ash receptacle has having a front wall, rear wall, side walls, and bottom, said front wall having an air intake opening that communicates with said second air intake duct;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path;

first and second air intake ducts communicating the exterior of said housing with the interior of said combustion assembly housing; and combustion gas conduit means communicating with said primary combustion chamber assembly and configured to transmit combustion gases produced within said combustion assembly housing along a tortuous path to thereby heat the environment located in heating proximity to said pellet stove.

11. A pellet stove comprising:

a combustion assembly housing having a top, bottom, front, rear wall, and opposing side walls;

a primary combustion chamber assembly located within said housing;

a secondary combustion chamber assembly located within said housing below said primary combustion chamber assembly;

an ash receptacle located within said housing below said secondary combustion chamber assembly;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path, said pellet feeder including a pellet feed housing having a top, bottom, opposing sides, front and rear, a pellet inlet opening in said top adjacent the front thereof, said pellet inlet opening being configured to receive pellets from an external pellet supply, a pellet outlet opening in said bottom adjacent the rear thereof, said pellet outlet opening being in substantial alignment with said upper grate receiving opening of said tubular grate insert of said primary combustion chamber, and a pellet feed plate sloping downwardly and rearwardly from said pellet inlet opening to said pellet outlet opening;

first and second air intake ducts communicating the exterior of said housing with the interior of said combustion assembly housing; and combustion gas conduit means communicating with said primary combustion chamber assembly and configured to transmit combustion gases produced within said combustion assembly housing along a tortuous path to thereby heat the environment located in heating proximity to said pellet stove.

12. The pellet stove of claim 11 wherein said external pellet supply includes a pellet hopper and a pellet feed tube communicating said pellet hopper with said pellet inlet opening of said pellet feed housing.

13. A pellet stove comprising:

a combustion assembly housing having a top, bottom, front, rear wall, and opposing side walls;

a primary combustion chamber assembly located within said housing;

a secondary combustion chamber assembly located within said housing below said primary combustion chamber assembly;

an ash receptacle located within said housing below said secondary combustion chamber assembly;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path;

first and second air intake ducts communicating the exterior of said housing with the interior of said combustion assembly housing; and combustion gas conduit means communicating with said primary combustion chamber assembly and configured to transmit combustion gases produced within said combustion assembly housing along a tortuous path to thereby heat the environment located in heating proximity to said pellet stove;

said front of said combustion assembly housing being open and having a latchable door attached thereto, said door configured to pivot from a first, closed and latched position covering the open front of said combustion assembly housing, to a second, open position allowing access to said primary combustion chamber, said secondary combustion chamber, and said ash receptacle.

14. The pellet stove of claim 13 wherein said front of said pellet feeder is open and said latchable door extends upwardly a distance sufficient to cover said open front of said pellet feeder when said latchable door is in its first, closed and latched position.

15. A pellet stove comprising:

a combustion assembly housing having a top, bottom, an open front, rear wall, and opposing side walls;

a primary combustion chamber assembly located within said housing;

a secondary combustion chamber assembly located within said housing below said primary combustion chamber assembly;

an ash receptacle located within said housing below said secondary combustion chamber assembly;

said primary combustion chamber assembly communicating with said secondary combustion chamber assembly and said secondary combustion chamber assembly communicating with said ash receptacle;

a pellet feeder located on the top of said combustion assembly housing and configured to feed pellets directly into said primary combustion chamber assembly along an inclined path, said pellet feeder including a pellet feed housing having a top, bottom, opposing sides, an open front, and a rear, a pellet inlet opening in said top adjacent the front thereof, said pellet inlet opening being configured to receive pellets from an external pellet supply, a pellet outlet opening in said bottom adjacent the rear thereof, said pellet outlet opening being in substantial alignment with said upper grate receiving opening of said tubular grate insert of said primary combustion chamber, and a pellet feed plate sloping downwardly and rearwardly from said pellet inlet opening to said pellet outlet opening;

a latchable door pivotally attached to said combustion assembly housing, said door configured to pivot from a first, closed and latched position covering the open front of said combustion assembly housing and said open front of said pellet feed housing, to a second, open position allowing access to said primary combustion chamber, said secondary combustion chamber, said ash receptacle, and said pellet feed housing;

first and second air intake ducts extending through said latchable door and communicating the exterior of said combustion assembly housing with the interior thereof, said first air intake duct communicating the exterior of said housing with said secondary combustion chamber assembly, and said second air intake duct communicating the exterior of said housing with said ash receptacle; and combustion gas conduit means communicating with said primary combustion chamber assembly and configured to transmit combustion gases produced within said combustion assembly housing along a tortuous path to thereby heat the environment located in heating proximity to said pellet stove.

* * * * *